US007749583B2

(12) United States Patent
Fugitt et al.

(10) Patent No.: US 7,749,583 B2
(45) Date of Patent: Jul. 6, 2010

(54) LOW DENSITY PAPERBOARD

(75) Inventors: Gary P. Fugitt, Pittsboro, NC (US); Terrell J. Green, Raleigh, NC (US); Steve G. Bushhouse, Cary, NC (US); Steven Parker, Raleigh, NC (US); Jason Richard Hogan, Glenn Allen, VA (US); Wei-Hwa Her, Beaumont, TX (US); Scott Ginther, Willow Spring, NC (US)

(73) Assignee: Meadwestvaco Corporation, Glen Allen, VA (US)

( * ) Notice: Subject to any disclaimer, the term of this patent is extended or adjusted under 35 U.S.C. 154(b) by 0 days.

(21) Appl. No.: 12/412,773

(22) Filed: Mar. 27, 2009

(65) Prior Publication Data

US 2009/0297808 A1 Dec. 3, 2009

Related U.S. Application Data

(60) Provisional application No. 61/056,712, filed on May 28, 2008.

(51) Int. Cl.
*D21H 11/20* (2006.01)

(52) U.S. Cl. ..... 428/34.2; 428/532; 428/534; 428/535; 428/537.5; 162/82; 162/157.1; 162/157.2; 162/157.6; 162/158; 162/182

(58) Field of Classification Search ..... 428/34.2, 428/532, 534, 535, 537.5; 162/82, 157.1, 162/157.2, 157.6, 158, 182
See application file for complete search history.

(56) References Cited

U.S. PATENT DOCUMENTS

| | | | | |
|---|---|---|---|---|
| 4,749,445 | A | 6/1988 | Vreeland et al. | |
| 4,888,983 | A | 12/1989 | Dunfield et al. | |
| 5,298,335 | A | 3/1994 | Reed et al. | |
| 5,320,672 | A | 6/1994 | Whalen-Shaw | |
| 5,631,080 | A | 5/1997 | Fugitt | |
| 5,690,527 | A | 11/1997 | Rutledge et al. | |
| 6,582,553 | B2 * | 6/2003 | Jewell et al. | 162/9 |
| 6,777,075 | B2 | 8/2004 | Concannon et al. | |
| 6,802,938 | B2 * | 10/2004 | Mohan et al. | 162/135 |
| 6,866,906 | B2 * | 3/2005 | Williams et al. | 428/34.2 |
| 7,208,039 | B2 | 4/2007 | Jones et al. | |
| 7,306,668 | B2 | 12/2007 | Pring et al. | |
| 7,425,246 | B2 * | 9/2008 | Urscheler | 162/137 |
| 7,504,002 | B2 * | 3/2009 | Brelsford et al. | 162/205 |
| 2003/0085012 | A1 | 5/2003 | Jones et al. | |
| 2004/0065423 | A1 | 4/2004 | Swerin et al. | |
| 2004/0229063 | A1 | 11/2004 | Concannon et al. | |
| 2005/0039871 | A1 | 2/2005 | Urscheler et al. | |
| 2006/0009566 | A1 | 1/2006 | Jones et al. | |
| 2006/0124033 | A1 | 6/2006 | Pruett et al. | |
| 2007/0169902 | A1 | 7/2007 | Brelsford et al. | |
| 2008/0060774 | A1 * | 3/2008 | Zuraw et al. | 162/135 |
| 2008/0311416 | A1 | 12/2008 | Kelly et al. | |

FOREIGN PATENT DOCUMENTS

| | | | |
|---|---|---|---|
| EP | 0448332 | * | 9/1991 |
| JP | 01-118692 | | 5/1989 |
| JP | 2009001953 | | 1/2009 |
| JP | 2009013513 | | 1/2009 |
| WO | 98/51860 | | 11/1998 |
| WO | 01/14014 | | 3/2001 |
| WO | 2006/033952 | | 3/2006 |
| WO | WO 2009/091406 | | 9/2009 |
| WO | WO2009/091406 | * | 9/2009 |

OTHER PUBLICATIONS

Z. Richard Zhang, Roger W. Wygant, Anthony V. Lyons and Frank A. Adamsky, "How Coating Structure Relates to Performance in Coated SBS Board: A Fundamental Approach", 1999 Tappi Coating Conference, May 1999.

Z.Richard Zhang, Roger W. Wygant and Anthony V. Lyons, "A Fundamental Approach to Understand the Relationship Between Top Coat Structure and Paper Performance", TAPPI Journal, vol. 84, No. 3, Mar. 2001.

R.W. Wygant, "Coating Pigment Formulation Selection to Optimize the Quality of Matte Lightweight-Coated Paper", 2003 TAPPI Spring Technical Conference, May 2003.

R.W. Wygant, "Multi-Pigment Formulations Contribute to the Rise of Matte LWC: formulations for matte coatings in acid systems have been developed and tested", TAPPI Solutions! for People, Process, and Paper, May 2003.

R.W. Wygant, "Coating Formulation Optimization", 2004 TAPPI Coating and Graphic Arts Conference, May 2004.

Robert J. Pruett, Jun Yuan, Bomi M. Bilimoria, Roger W. Wygant and Anthony V. Lyons, "Fine Platy Kaolin Composition", European Patent EP1587882, Jul. 22, 2004.

(Continued)

*Primary Examiner*—Leszek Kiliman

(57) ABSTRACT

A paperboard including a solid bleached sulfate paperboard substrate and a coating applied to the paperboard substrate to form a coated structure, the coated structure having a basis weight, a caliper thickness and a Parker Print Surf smoothness, the Parker Print Surf smoothness being at most about 3 microns, the basis weight being at most about $Y_1$ pounds per 3000 $ft^2$, wherein $Y_1$ is a function of the caliper thickness (X) in points and is calculated as follows: $Y_1=3.79+13.43X-0.1638X^2$.

18 Claims, 10 Drawing Sheets

OTHER PUBLICATIONS

Richard Gagnon, Jan Walter, Joel Kendrick, Rajan Iyer, Leslie McLain, Roger Wygant, "Metered Size Press Coating Formulation Design for Fiber Reduction", TAPPI 2007 Coating and Graphics Arts Conference, Miami, FL, USA, Apr. 2007.

Roger Wygant, Richard Gagnon, Joel Kendrick, Jan Walter, "Fiber Savings Through New MSP Formulation Strategies", Pulp and Paper, Nov. 2007.

Wygant, J. Kendrick, J. Walter, "Metered Size Press Pigmentation for Fiber Reduction," TAPPI 2008 Coating and Graphic Arts Conference, Dallas, TX, May 2008.

Benny Hallam, Chris Nutbeem, Tatsuya Asano, "Optimisation of Steep Carbonate Coating Formulations With Ultra Fine Platy Kaolin", Tappi Coating and Graphic Arts Conference, Miami, May 2007.

Preston J.S., Toivakka M., Heard P.J., "Visualisation, Modelling and Image Analysis of Coated Paper Microstructure: Particle Shape—Microstructure Interrelations" Proc. 2nd IPEC Conference Tianjin China May 9-11, pp. 833-839 (Date Unknown).

Preston J.S. Husband J.C., Norouzi N., Blair D., Heard P., "The Measurement and Analysis of the Distribution of Fountain Solution in Kaolin and Calcium Carbonate Coatings" Proc 2008 Tappi PaperCon, Dallas Tx May 4-7, 2008.

J.C.Husband, J.S.Preston, LF.Gate, A.Storer and P.Creaton, "A Study of In-Plane and z-direction Strength of Coating Layers with varying Latex Content", 6th International Paper and Coating Chemistry Symposium, Stockholm, Jun. 7-9, 2006, published in TAPPI J., 6, 12, 10-16, 2008.

Preston J.S., Hiorns A.G., Heard P., Parsons D.J. "Design of coating structure for flexographic printing" Proc. 2007 Tappi Coating Conference, Miami Apr. 2007.

Husband J.C., Preston J.S., Gate L.F., Blair D., Creaton P.,"Factors affecting the printing strength of kaolin based coatings" Proc. 2007 Tappi Coating Conference, Miami Apr. 2007.

Preston J.S., Nutbeem C., Heard P.J., Wygant R. "Coating Structure Requirements for Improved Rotogravure Printability and Reduced Ink Demand" Tappi Int Printing & Graphic Arts Conf., Cincinnati , Sep. 20-22, 2006.

Elton N.J., Preston J.S., "Polarized light reflectometry for studies of paper coating structure—Part II. Application to coating structure, gloss and porosity" Tappi Journal Aug. 2006, vol. 5, No. 8, pp. 10-16.

Dr Sanna Rousu, Dr Janet Preston, Jan Gustafsson, Dr Peter Heard, "Interactions between UV Curing, hybrid-UV and sheetfed Offset Inks and Coated Paper—Part 2 Commercial print trials" TAGA Journal, vol. 2, Edition 3, Apr. 2006, pp. 174-189.

Dr Janet Preston, Dr Sanna Rousu, Dr Roger Wygant, Mr John Parsons, Dr Peter Heard, "Interactions between UV curing offset inks and coated paper—Part 1 Laboratory Investigations" TAGA Journal, vol. 2, Edition 2, Nov. 2005, pp. 82-98.

Hiorns A.G., Preston J.S., "Optimization of Coating, Paper Key to Blade and MSP Coater use" Pulp & Paper, Jul. 2005 vol. 79, No. 7 pp. 44-47.

C. Nutbeem, J.C. Husband and J.S. Preston, "The role of pigments in controlling coating structure" 2005 PITA coating conf Bradford.

Preston J., Hiorns T.K, Husband J., Nutbeem C., "Overview of coating structure and influence of applicator type", Location and Date Unknown.

Preston J.S., Daun M., Nutbeem C., Jones A., "Attaining print performance through pigment engineering", Presented at the 1999 PTS Coating Conference Munich Sep. 1999.

Preston J.S., Nutbeem C., Parsons D.J., Jones A., "The printability of coated papers with controlled microstructures", Presented at the 1999 PITA Conference, Edinburgh.

Brociner, R.E. And Beazley, K.M., "The influence of the coating pigment on missing dots in LWC gravure paper", TAPPI J., 63 (5):55 (1980).

Elton, N.J., Gate, L.F., Hooper, J.J., "Texture and orientation of kaolin in coatings", Clay Minerals, 34, 89-98 (1999).

Adams, J.M , "Particle size and shape effects in materials science: examples from polymer and paper systems", Clay Minerals, 28, 509-530 (1993).

J.C.Husband and A.V.Lyons, "Engineered Coating Clays for Future Needs", 7th International Conference on New Available Technologies, Jun. 4-6, 2002, Stockholm. Proceedings p. 191-195. Published by SPCI.

J.C.Husband, J.S.Preston, L.F.Gate, A.Storer and P.Creaton, "The Influence of Pigment Particle Shape on the In-plane Tensile Strength Properties of Kaolin-based Coating Layers", TAPPI Advanced Coating Fundamentals Symposium, Turku, Feb. 8-10, 2006. Published in Conference Proceedings, p. 67-80, and in TAPPI J., 5, 12, 3-8, 2006.

J.C.Husband, J.S.Preston, L.F.Gate, P.Creaton and D.Blair, "Factors Affecting the Printing Strength of Kaolin-based Paper Coatings", TAPPI Coating Conference, Miami, Apr. 22-25, 2007. Published in Conference Proceedings, and in TAGA J., 4, p. 84-100 (2008).

J.C.Husband, "Use of High Aspect Ratio Kaolin as a tool to Control the Strength and Stiffness Properties of Coated Paper", 50th Japan TAPPI Annual Meeting, Takamatsu, Oct. 10-12, 2007. Published in Japan TAPPI Journal, Jun. 2008.

J.S.Preston, J.C.Husband, N. Norouzi, D.Blair and P.J.Heard, "The Measurement and Analysis of the Distribution of Fountain Solution in Kaolin and Calcium Carbonate Containing Coatings", TAPPI Coating Conference, Dallas, May 4-7, 2008. Published in Conference Proceedings.

Hiorns A.G., Preston J.S. and Fogelholm R.,"The role of the base paper in controlling MSP and Spray LWC paper quality", PITA Coating Conference, Bradford, Mar. 2005.

Preston J.S. And Hiorns A.G., "A comparison of LWC papers produced using Blade and MSP coaters", Paper Technology, vol. 45, No. 6, Jul. 2004.

Drage, P.G.; Hiorns, A.G.; Parsons, D.J.; Coggon, L., "Factors governing print performance in offset printing of matt papers", PTS Coating Symposium, Munich, Sep. 1997.

Hiorns, A.G.; Sharma, S., "Possibilities for upgrading woodcontaining papers by coating with a metered size-press", Pulp & Paper Canada, 97:2, 1996.

Hiorns, A.G., Drage. P.G., "Surface quality enhancement by selective pigmentation", 10th PTS Symposium of Papermaking, Munich, Sep. 1992.

Hiorns A.G., Kent, D.F, Parsons D.J. and Underwood J., "Enhanced performance through multilayer coating",TAPPI Coating Conference, Toronto, Apr. 2005.

Hiorns A.G. And Winter H., "Effect of kaolin addition to calcium carbonate precoats: Part 2—MSP coating", TAPPI Coating Conference, Baltimore, May 2004.

Hiorns A.G. and Eade T., "Particle packing of blocky and platey pigments—A comparison of computer simulation and experimental results", TAPPI Advanced Coating Fundamentals Symposium, Chicago, May 2003.

Hiorns A.G. and Eade T., "Effect of kaolin addition to calcium carbonate precoats", TAPPI Spring Technical Conference, Chicago, May 2003.

Hiorns, A.G., "Calendering response of calcium carbonates in double coated woodfree paper", TAPPI Coating Conference, San Diego, May 2001.

Hiorns, A.G., "Producing LWC rotogravure paper on a metered size press", TAPPI Metered Size Press Forum III, Washington DC, Apr. 2000.

Hiorns, Anthony et al., "Effects of Kaolin Addition to Calcium Carbonate Precoats: Part 2: MSP Coating," TAPPI Coating Conference, Baltimore, Maryland, May 2004.

Office Action, U.S. Appl. No. 12/326,430 (Apr. 9, 2009).

Office Action, U.S. Appl. No. 12/326,430 (Jul. 8, 2009).

Office Action, U.S. Appl. No. 12/326,430 (19 pages) (Oct. 22, 2009).

Final Office Action, U.S. Appl. No. 12/326,430; 13 pages (Jan. 25, 2010).

PCT, International Search Report, International Application No. PCT/US2009/000467; 5 pages (mailed Aug. 25, 2009; published Sep. 24, 2009).

PCT, International Search Report, International Application No. PCT/US2009/038865; 4 pages (mailed Aug. 28, 2009; published Dec. 3, 2009).

Search report from Specialized Patent Services dated Oct. 17, 2008; 4 pages.

Basis weight versus caliper thickness data ("Production Data") shown as a scatter plot against Y1 (the higher of $Y_1$ and $Y_1$') and Y2 (the higher of $Y_2$ and $Y_2$'), wherein the Production Data was collected between Jan. 1, 2008 and Apr. 30, 2008 using a scanning gauge on the papermaking machine during commercial production of C1S solid bleached sulfate paperboard. The resulting coated paperboard had a Parker Print Surf smoothness below 3 microns, possibly even below 2 microns. The Production Data was collected prior to moisture absorption to achieve equilibrium moisture content and prior to the densification associated with moving the coated paperboard across the reel and winder.

* cited by examiner

LOW DENSITY PAPERBOARD

PRIORITY

The present patent application claims priority from U.S. Ser. No. 61/056,712 filed on May 28, 2008, the entire contents of which are incorporated herein by reference.

BACKGROUND

The present patent application is directed to low density paperboard and, more particularly, to low density paperboard having a smooth surface.

Paperboard is commonly used in various packaging applications. For example, aseptic liquid packaging paperboard is used for packaging beverage containers, boxes and the like. Therefore, customers often prefer paperboard having a generally smooth surface with few imperfections to facilitate the printing of high quality text and graphics, thereby increasing the visual appeal of products packaged in paperboard.

Conventionally, paperboard smoothness is achieved by a wet stack calendering process in which the paperboard is rewetted and passed through a calendering device having two or more hard rolls. The wet stack calendering process smoothes the paperboard by compressing the fiber network to eliminate the pits and crevices in the raw stock board. Therefore, smooth paperboard is typically more dense (i.e., less bulky) than less smooth paperboard.

For example, in FIG. 1, the basis weight in pounds per ream (1 ream 3000 $ft^2$) of certain prior art solid bleached sulfate (SBS) paperboard products is plotted against caliper thickness (1 point=0.001 inch), thereby providing a visual representation of prior art paperboard density (i.e., basis weight divided by caliper thickness). As can be seen, the data points generally fall within a range between curve $R_1$ and curve $R_2$. Lower density paperboard (i.e., paperboard falling below curve $R_1$), particularly low density paperboard having a smooth surface, has not been observed in the prior art.

Nonetheless, low density is a desirable quality in many paperboard applications. However, preparing a smooth paperboard using the conventional wet stack calendering process requires substantially increasing the paperboard density.

Accordingly, there is a need for a low density paperboard that provides the desired smoothness for high quality printing, while reducing manufacturing cost.

SUMMARY

In one aspect, the disclosed low density paperboard may include a fiber substrate and a coating applied to the fiber substrate to form a coated structure, the coated structure having a Parker Print Surf smoothness of at most about 3 microns, a caliper thickness and a basis weight, the basis weight being at most about $Y_1$, wherein $Y_1$ is a function of the caliper thickness (X) in points and is calculated using Eq. 1 as follows:

$$Y_1=3.79+13.43X-0.1638X^2 \quad \text{(Eq. 1)}$$

In another aspect, the disclosed low density paperboard may include a fiber substrate and a coating applied to the fiber substrate to form a coated structure, the coated structure having a Parker Print Surf smoothness of at most about 3 microns, a caliper thickness and a basis weight, the basis weight being at most about $Y_2$, wherein $Y_2$ is a function of the caliper thickness (X) in points and is calculated using Eq. 2 as follows:

$$Y_2=3.71+13.14X-0.1602X^2 \quad \text{(Eq. 2)}$$

In another aspect, the disclosed low density paperboard may include a fiber substrate and a coating applied to the fiber substrate to form a coated structure, the coated structure having a Parker Print Surf smoothness of at most about 3 microns, a caliper thickness and a basis weight, the basis weight being at most about $Y_3$, wherein $Y_3$ is a function of the caliper thickness (X) in points and is calculated using Eq. 3 as follows:

$$Y_3=3.63+12.85X-0.1566X^2 \quad \text{(Eq. 3)}$$

In another aspect, the disclosed low density paperboard may include a fiber substrate and a coating applied to the fiber substrate to form a coated structure, the coated structure having a Parker Print Surf smoothness of at most about 3 microns, a caliper thickness and a basis weight, the basis weight being at most about $Y_4$, wherein $Y_4$ is a function of the caliper thickness (X) in points and is calculated using Eq. 4 as follows:

$$Y_4=3.50+12.41X-0.1513X^2 \quad \text{(Eq. 4)}$$

In another aspect, the disclosed low density paperboard may include a fiber substrate, a topcoat, and a coating positioned between the fiber substrate and the topcoat, the fiber substrate, the basecoat and the topcoat forming a coated structure, wherein the coated structure has a Parker Print Surf smoothness of at most about 3 microns, a caliper thickness and a basis weight, the basis weight being at most about $Y_5$, wherein $Y_5$ is a function of the caliper thickness (X) in points and is calculated using Eq. 5 as follows:

$$Y_5=3.30+11.68X-0.1424X^2 \quad \text{(Eq. 5)}$$

In yet another aspect, the disclosed low density paperboard may include a fiber substrate and a coating applied to the fiber substrate to form a coated structure, the coated structure having a Parker Print Surf smoothness of at most about 3 microns, a caliper thickness and a basis weight, the basis weight being at most about $Y_1'$ wherein $Y_1'$ is a function of the caliper thickness (X) in points and is calculated using Eq. 6 as follows:

$$Y_1'=36.26+8.3432X+0.01629X^2 \quad \text{(Eq. 6)}$$

In yet another aspect, the disclosed low density paperboard may include a fiber substrate and a coating applied to the fiber substrate to form a coated structure, the coated structure having a Parker Print Surf smoothness of at most about 3 microns, a caliper thickness and a basis weight, the basis weight being at most about $Y_2'$ wherein $Y_2'$ is a function of the caliper thickness (X) in points and is calculated using Eq. 7 as follows:

$$Y_2'=35.55+8.173X+0.01602X^2 \quad \text{(Eq. 7)}$$

In yet another aspect, the disclosed low density paperboard may include a fiber substrate and a coating applied to the fiber substrate to form a coated structure, the coated structure having a Parker Print Surf smoothness of at most about 3 microns, a caliper thickness and a basis weight, the basis weight being at most about $Y_3'$ wherein $Y_3'$ is a function of the caliper thickness (X) in points and is calculated using Eq. 8 as follows:

$$Y_3'=34.83+8.010X+0.01570X^2 \quad \text{(Eq. 8)}$$

In yet another aspect, the disclosed low density paperboard may include a fiber substrate and a coating applied to the fiber substrate to form a coated structure, the coated structure having a Parker Print Surf smoothness of at most about 3 microns, a caliper thickness and a basis weight, the basis weight being at most about $Y_4'$ wherein $Y_4'$ is a function of the caliper thickness (X) in points and is calculated using Eq. 9 as follows:

$$Y_4'=33.79+7.769X+0.01524X^2 \quad \text{(Eq. 9)}$$

In yet another aspect, the disclosed low density paperboard may include a fiber substrate, a topcoat, and a coating positioned between the fiber substrate and the topcoat, the fiber substrate, the basecoat and the topcoat forming a coated structure, wherein the coated structure has a Parker Print Surf smoothness of at most about 3 microns, a caliper thickness and a basis weight, the basis weight being at most about $Y_5'$, wherein $Y_5'$ is a function of the caliper thickness (X) in points and is calculated using Eq. 10 as follows:

$$Y_5'=32.77+7.537X+0.01475X^2 \quad \text{(Eq. 10)}$$

Other aspects of the disclosed low density paperboard will become apparent from the following description, the accompanying drawings and the appended claims.

DETAILED DESCRIPTION

Figure 2:
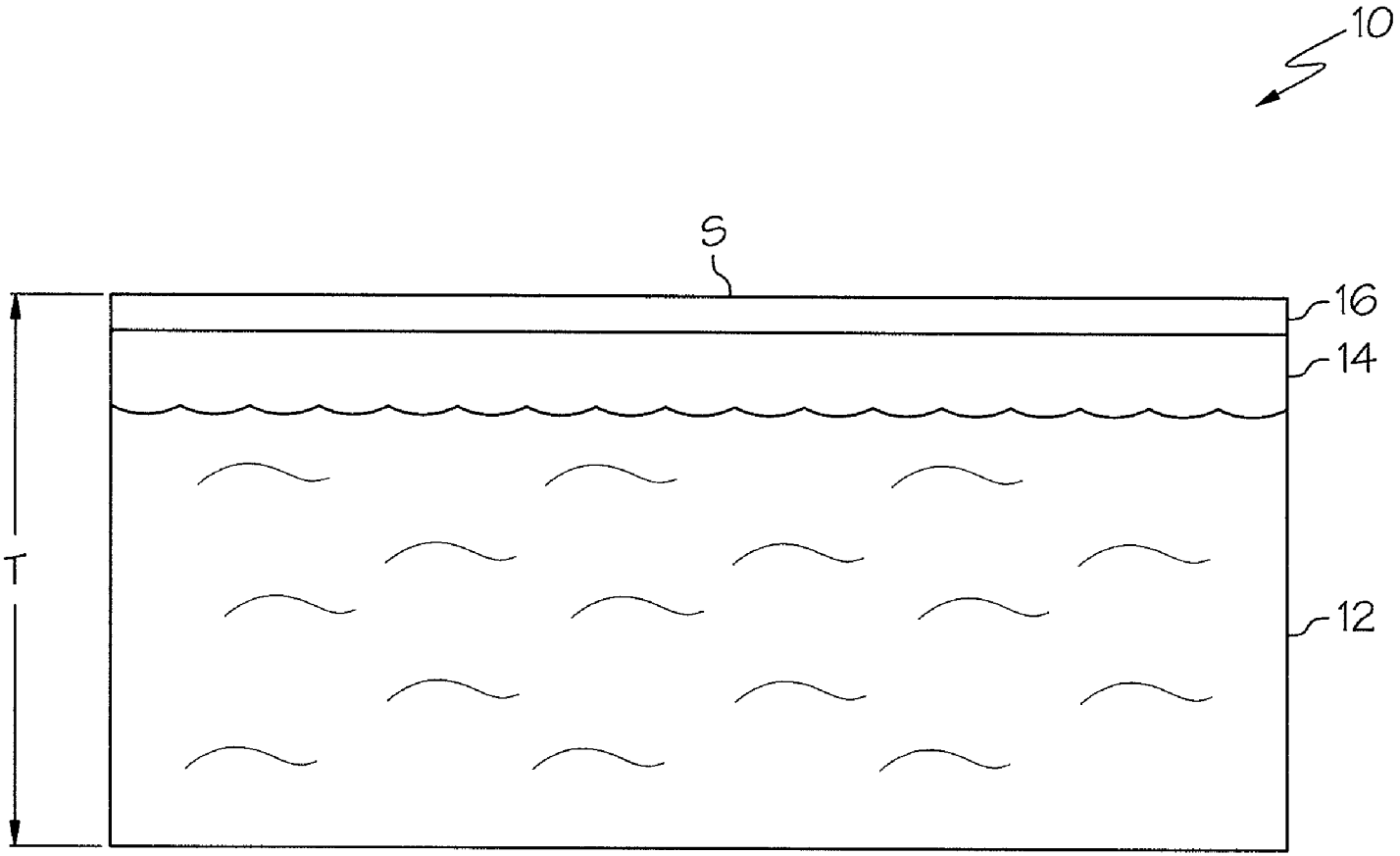
FIG. 2 is a cross-sectional view of one aspect of the disclosed low density paperboard.

Referring to FIG. 2, one aspect of the disclosed low density paperboard, generally designated 10, may include a fiber substrate 12, a basecoat 14 and a topcoat 16. The paperboard 10 may have a caliper thickness T and an upper surface S upon which text or graphics may be printed. Additional layers may be used without departing from the scope of the present disclosure.

In one aspect, the fiber substrate 12 may be a paperboard substrate. As used herein, "paperboard substrate" broadly refers to any paperboard material that is capable of being coated with a basecoat, and may be a single-ply substrate or a multi-ply substrate. Those skilled in the art will appreciate that the paperboard substrate may be bleached or unbleached, and typically is thicker and more rigid than paper. Generally, a paperboard substrate has an uncoated basis weight of about 85 pounds per 3000 $ft^2$ or more. Examples of appropriate paperboard substrates include corrugating medium, linerboard and solid bleached sulfate (SBS). In one particular aspect, the fiber substrate 12 may include a substantially chemically (rather than mechanically) treated fiber, such as an essentially 100 percent chemically treated fiber. Examples of appropriate chemically treated fiber substrates 12 include solid bleached sulfate paperboard or solid unbleached sulfate paperboard.

Additional components, such as binders, fillers, pigments and the like, may be added to the fiber substrate 12 without departing from the scope of the present disclosure. Furthermore, the fiber substrate 12 may be substantially free of plastic pigments for increasing bulk, such as hollow plastic pigments or expandable microspheres, or other chemical bulking agents. Still furthermore, the fiber substrate 12 may be substantially free of ground wood particles.

The topcoat 16 is an optional layer and may be any appropriate topcoat. For example, the topcoat 16 may include calcium carbonate, clay and various other components and may be applied to the basecoat 14 as a slurry. Topcoats are well known by those skilled in the art and any conventional or non-conventional topcoat 16 may be used without departing from the scope of the present disclosure.

The basecoat 14 and topcoat 16 may be any coating that improves the smoothness of the surface S of the paperboard 10 without substantially reducing the caliper thickness T of the paperboard 10, thereby yielding a smooth (e.g., Parker Print Surf smoothness below about 3.0 microns) and low density paperboard. Those skilled in the art will appreciate that the basecoat 14, as well as the techniques (discussed below) for applying the basecoat 14 to the fiber substrate 12, may be significant factors in maintaining a low density product.

In a first aspect, the basecoat 14 may be a carbonate/clay basecoat. The carbonate/clay basecoat may include a ground calcium carbonate component, a platy clay component and various optional components, such as latex binders, thickening agents and the like. The carbonate/clay basecoat may be dispersed in water such that it may be applied to the fiber substrate 12 as a slurry using, for example, a blade coater such that the carbonate/clay basecoat substantially fills the pits and crevices in the fiber substrate 12 without substantially coating the entire surface of the fiber substrate 12.

The ground calcium carbonate component may be a coarse ground calcium carbonate, such as CARBITAL® 60 available from Imerys Pigments, Inc. of Roswell, Ga., or an extra coarse ground calcium carbonate, such as CARBITAL® 35, also available from Imerys Pigments, Inc. The platy clay component may be a high aspect ratio clay having an aspect ratio (i.e., the ratio of the clay particle length or diameter to the thickness), on average, of about 50:1, such as CONTOUR® 1180 available from Imerys Pigments, Inc., or a very high aspect ratio clay having an aspect ratio, on average, of about 90:1, such as XP-6100 (also known as BARRISURF X) also available from Imerys Pigments, Inc.

Specific examples of appropriate carbonate/clay basecoats, as well as techniques for applying such basecoats to a fiber substrate 12, are disclosed in U.S. Ser. No. 61/038,579 filed on Mar. 21, 2008, the entire contents of which are incorporated herein by reference.

Figure 4:
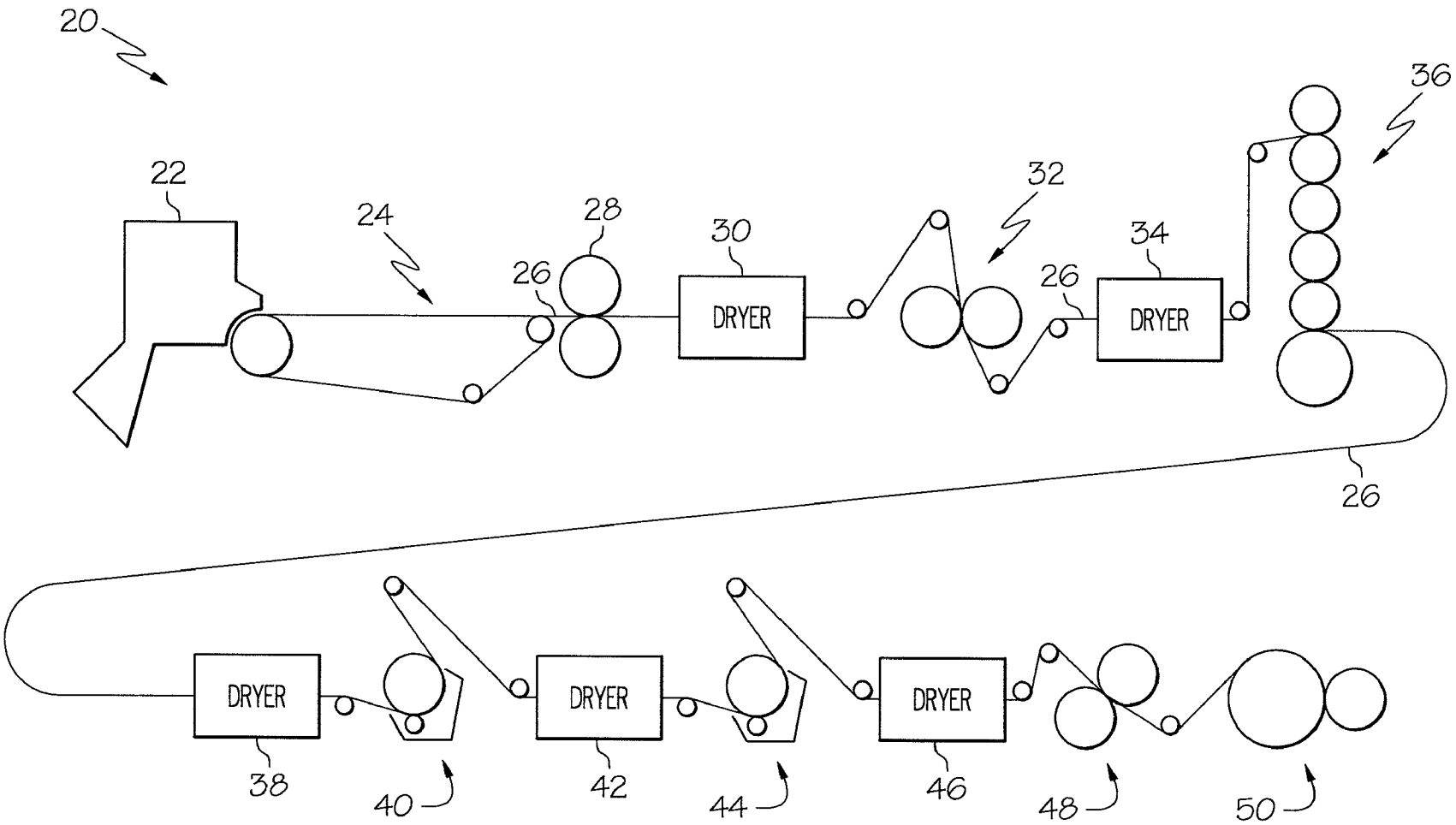
FIG. 4 is a schematic illustration of a first aspect of a process for preparing the disclosed low density paperboard.

Accordingly, in one aspect, a low density paperboard 10 may be prepared by the process 20 illustrated in FIG. 4. The process 20 may begin at the head box 22 which may discharge a fiber slurry onto a Fourdrinier 24 to form a web 26. The web 26 may pass through one or more wet presses 28 and, optionally, through one or more dryers 30. A size press 32 may be used and may slightly reduce the caliper thickness of the web 26 and an optional dryer 34 may additionally dry the web 26. In one aspect, the web 26 may pass through a calender 36 with the nip loads substantially reduced to minimize or avoid reduction in caliper thickness. Preferably, the calender 36 would be run as a dry calender. In another aspect, the calender 36 may be omitted or bypassed. Then, the web 26 may pass through another optional dryer 38 and to the first coater 40. The first coater 40 may be a blade coater or the like and may apply the carbonate/clay basecoat 14 onto the web 26. An optional dryer 42 may dry, at least partially, the carbonate/clay basecoat 14 prior to application of the optional topcoat 16 at the second coater 44. Another optional dryer 46 may finish the drying process before the web 26 proceeds to the optional gloss calender 48 and the web 26 is rolled onto a reel 50.

In a second aspect, the basecoat 14 may be a film-forming polymer solution applied to the fiber substrate 12 and then brought into contact with a heated surface in a nip, causing the solution to boil and create voids in the film which remain after the film is dried, resulting in a smooth surface. The film forming polymer may be a starch and the heated surface may be a heated roll.

Specific examples of appropriate film-forming polymers, as well as techniques for applying such polymers to a fiber substrate, are disclosed in PCT/US07/04742 filed on Feb. 22, 2007, the entire contents of which are incorporated herein by reference, in U.S. Ser. No. 60/957,478 filed on Aug. 23, 2007, the entire contents of which are incorporated herein by reference, and in PCT/US07/19917 filed on Sep. 13, 2007, the entire contents of which are incorporated herein by reference.

Figure 5:
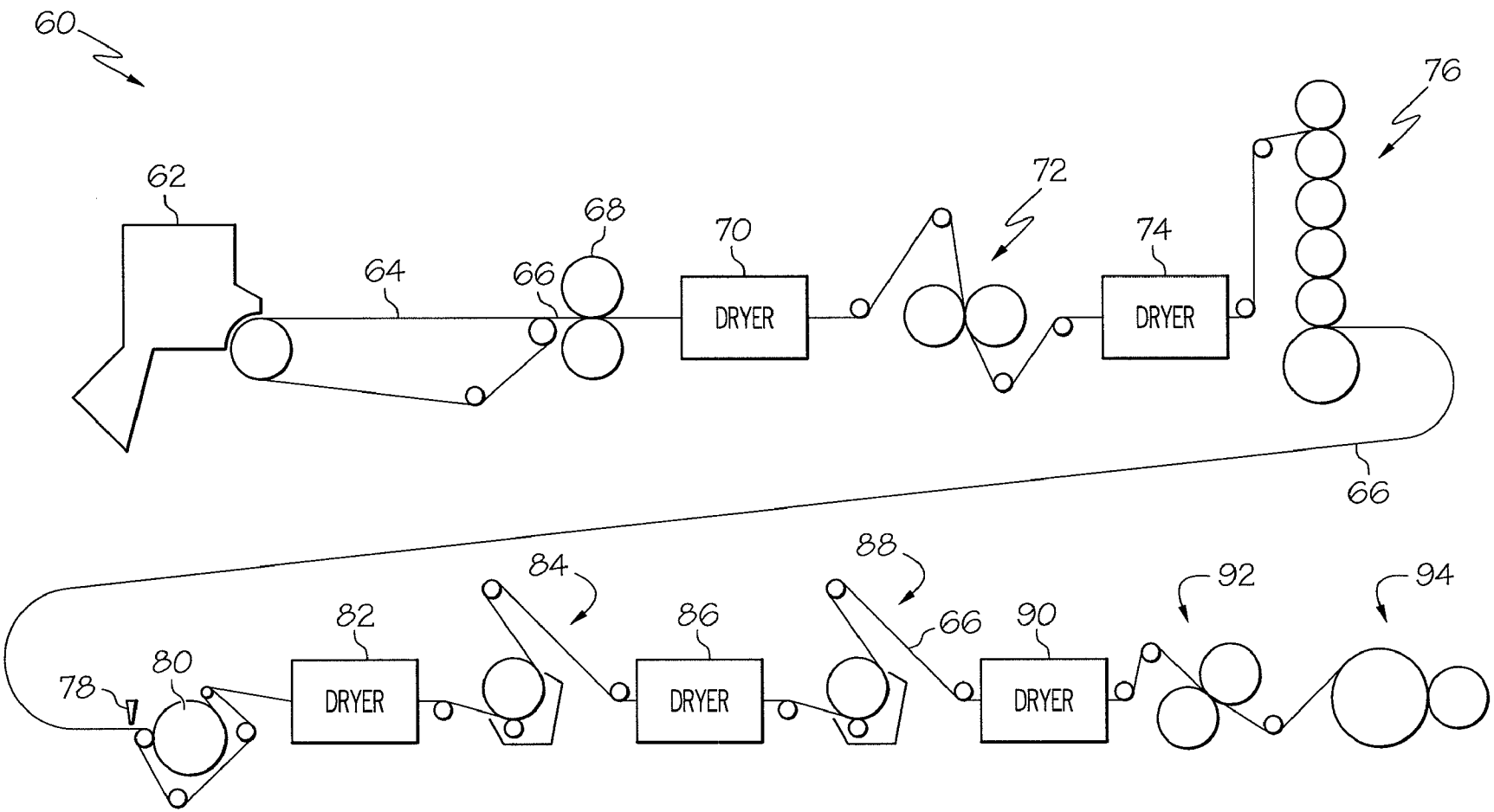
FIG. 5 is a schematic illustration of a second aspect of a process for preparing the disclosed low density paperboard.

Accordingly, in another aspect, a low density paperboard 10 may be prepared by the process 60 illustrated in FIG. 5. The process 60 may begin at the head box 62 which may discharge a fiber slurry onto a Fourdrinier 64 to form a web 66. The web 66 may pass through one or more wet presses 68 and, optionally, through one or more dryers 70. A size press 72 may be used, and may slightly reduce the caliper thickness of the web 66 and an optional dryer 74 may additionally dry the web 66. In one aspect, the web 66 may pass through a calender 76 with the nip loads substantially reduced to minimize or avoid reduction in caliper thickness. If used, the calender 76 may be run as a dry calender. In another aspect, the calender 76 may be omitted or bypassed. Then, the web 66 may pass to an application 78 of the film forming polymer followed by contacting in a nip with a heated roll 80 and a press roll to form a smooth surface with voids in the polymer film. After application and heat/pressure treatment of the film forming polymer, the web 66 may pass through another optional dryer 82 and to the first coater 84. The first coater 84 may be a blade coater or the like and may apply a conventional basecoat (e.g., as a second basecoat) onto the starch-coated web 66. An optional dryer 86 may dry, at least partially, the basecoat prior to application of an optional topcoat at the second coater 88. Another optional dryer 90 may finish drying before the web 66 proceeds to the optional gloss calender 92 and finished product is rolled onto a reel 94. The gloss calender 92 may be a soft nip calender, a hard nip calender, or may be omitted or bypassed.

At this point, those skilled in the art will appreciate that the basecoats 14, topcoats 16 and associated application techniques disclosed above may substantially increase the smoothness of the resulting paperboard 10 while essentially maintaining the caliper thickness of the fiber substrate 12 throughout the coating process.

EXAMPLES

Specific examples of smooth, low density paperboard prepared in accordance with the present disclosure are presented below.

Example 1

A low density uncoated solid bleached sulfate (SBS) board having a basis weight of about 120 lbs/3000 $ft^2$ was prepared using a full-scale production process.

A high-bulk, carbonate/clay basecoat was prepared having the following composition: (1) 50 parts high aspect ratio clay from Imerys Pigments, Inc., (2) 50 parts PG-3 from Omya (an extra coarse ground calcium carbonate), (3) 19 parts of a polyvinyl acetate latex (a binder), and (4) an alkali-swellable synthetic thickener in a quantity sufficient to raise the viscosity of the blend to 2500 centipoise, at 20 rpm, on a Brookfield viscometer.

A topcoat was prepared having the following composition: 50 parts fine carbonate; 50 parts fine clay; 17 parts polyvinyl acetate; and minor amounts of coating lubricant, plastic pigment, protein, dispersant, synthetic viscosity modifier, defoamer and dye.

The basecoat was applied to the uncoated board using a trailing bent blade applicator. The basecoat was applied such that the minimal amount of basecoat needed to fill the voids in the sheet roughness remained on the sheet, while scraping the excess basecoat from the sheet to leave a minimum amount of basecoat above the plane of the fiber surface. The basecoat was applied at a coat weight of about 6.0 lbs/3000 $ft^2$. The topcoat was applied over the basecoat to further improve the surface smoothness. The topcoat was applied at a coat weight of about 5.4 lbs/3000 $ft^2$.

The resulting coated structure had a total basis weight of about 130.0 lbs/3000 $ft^2$, a caliper of about 0.012 inches (12 points) and a Parker Print Surf (PPS 10S) smoothness of about 1.5 microns.

Example 2

A low density uncoated board having a basis weight of about 186.8 lbs/3000 $ft^2$ was prepared using a pilot production process.

A first basecoat was prepared as a 17 percent solids slurry including, by weight, 97 percent low molecular weight ethylated starch and 3 percent soybean oil-based release agent. The slurry was applied to the surface of the uncoated board at a coat weight of about 2.7 lbs/3000 $ft^2$. The treated board was then contacted with a polished drum at a temperature of about 430° F. and a pressure of about 200 pounds per lineal inch, thereby boiling the starch and shaping the surface of the board to replicate the drum surface. The resulting coated structure had a basis weight of 189.5 lbs/3000 $ft^2$, a caliper thickness of about 18.2 points and a PPS 10S smoothness of about 2.95 microns.

A second basecoat was prepared as a mixture of 100 parts ground calcium carbonate with 16 parts polyvinyl acetate latex as a binder and about 1.5 parts of a low molecular weight polyvinyl alcohol as a thickener. The second basecoat was applied to the coated board at a coat weight of about 2.5 lbs/3000 $ft^2$. The resulting coated structure had a basis weight of 191.8 lbs/3000 $ft^2$, a caliper thickness of about 18.1 points and a PPS 10S smoothness of about 2.28 microns.

A topcoat was prepared as a pigment blend of 70 parts fine clay, 30 parts fine ground calcium carbonate, 20 parts of a styrene-acrylic latex (a binder) and about 1.5 parts of a low molecular weight polyvinyl alcohol (a thickener). The topcoat was applied over the second basecoat at a coat weight of about 1.9 lbs/3000 $ft^2$. The resulting coated structure had a total basis weight of about 193.7 lbs/3000 $ft^2$, a caliper thickness of about 18.2 points, and a PPS 10S smoothness of about 1.26 microns.

Example 3

An uncoated board having a basis weight of about 185 lbs/3000 ft was coated with about 2.7 lbs/3000 $ft^2$ of starch using the first basecoat process described above in Example 2. The resulting coated structure had a total basis weight of about 187.7 lbs/3000 $ft^2$, a caliper thickness of about 17.9 points and a PPS 10S smoothness of about 2.40 microns.

Example 4

A low density uncoated board having a basis weight of about 112 lbs/3000 $ft^2$ was prepared using a full-scale production process. The basecoat of Example 2 was applied in the described manner at a coat weight of about 3.8 lbs/3000 $ft^2$.

A topcoat formulation was prepared as an 85/15 blend of a fine ground calcium carbonate and a fine coating clay, with 14 parts polyvinyl acetate latex and 2 part carboxymethyl cellulose (a water soluble thickener). The topcoat was applied over the basecoat using a typical topcoat application technique at a coat weight of about 6.6 lbs/3000 $ft^2$.

The resulting coated structure had a total basis weight of about 118.5 lbs/3000 $ft^2$, a caliper thickness of about 10 points and a PPS 10S smoothness of about 2.35 microns.

Example 5

Using the processes described in Example 2, a coated paperboard sample was prepared by applying a starch slurry at a coat weight of about 3 lbs/3000 $ft^2$ and a topcoat at a coat weight of about 6 lbs/3000 $ft^2$. The resulting coated structure had a basis weight of about 141.8 lbs/3000 $ft^2$, a caliper thickness of about 12.8 points and PPS 10S smoothness of about 2.20 microns.

Example 6

A low density uncoated board having a basis weight of about 119 lbs/3000 $ft^2$ was prepared using a full-scale production process. The uncoated board was coated with a starch slurry at a coat weight of about 3 lbs/3000 $ft^2$ using the first basecoat formulation and associated process described in Example 2. Samples 1 and 2 were collected without a topcoat. Samples 3 and 4 received a topcoat having the topcoat formulation described in Example 2 at a coat weight of about 8-9 lbs/3000 $ft^2$. Sample 4 also underwent a typical gloss calendering process. The resulting data is presented in Table 1:

TABLE 1

| Sample | Caliper (points) | Basis Weight (lbs/ream) | PPS 10S (microns) |
|---|---|---|---|
| 1 | 11.1 | 121.7 | 2.31 |
| 2 | 11 | 120.8 | 2.5 |
| 3 | 11.5 | 130 | 2.29 |
| 4 | 11.6 | 130 | 1.38 |

Figure 6:
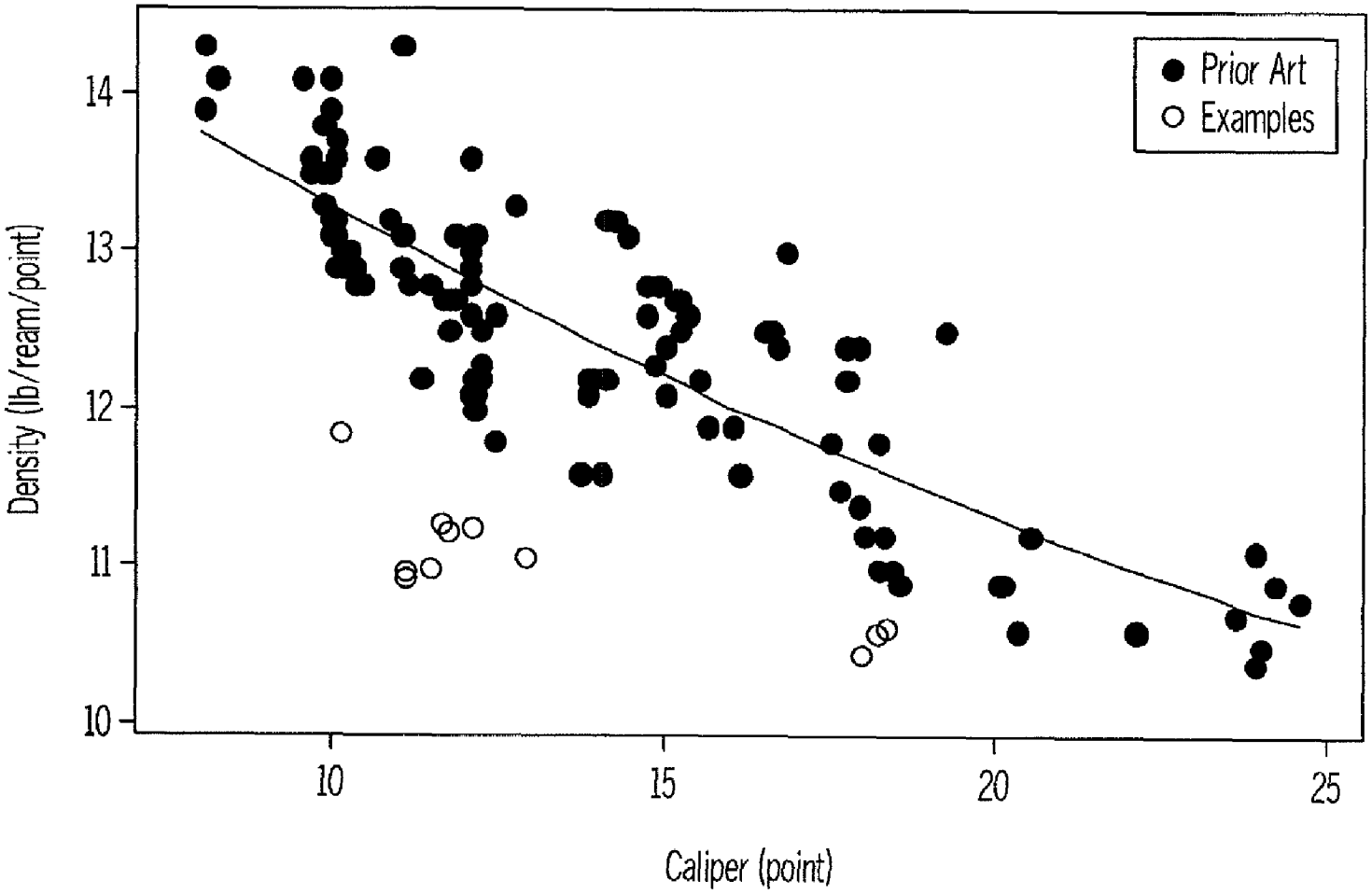
FIG. 6 is a graphical representation of density versus caliper thickness of various exemplary aspects of the disclosed low density paperboard.

The density (i.e., basis weight divided by caliper) versus caliper data from Examples 1-6, together with density versus caliper data for prior art paperboard, is plotted in FIG. 6. Those skilled in the art will appreciate that significantly lower densities are achieved when paperboard is prepared in accordance with the present disclosure. Those skilled in the art will also appreciate that density is a function of caliper, so one should compare individual calipers separately when evaluating PPS.

Figure 7:
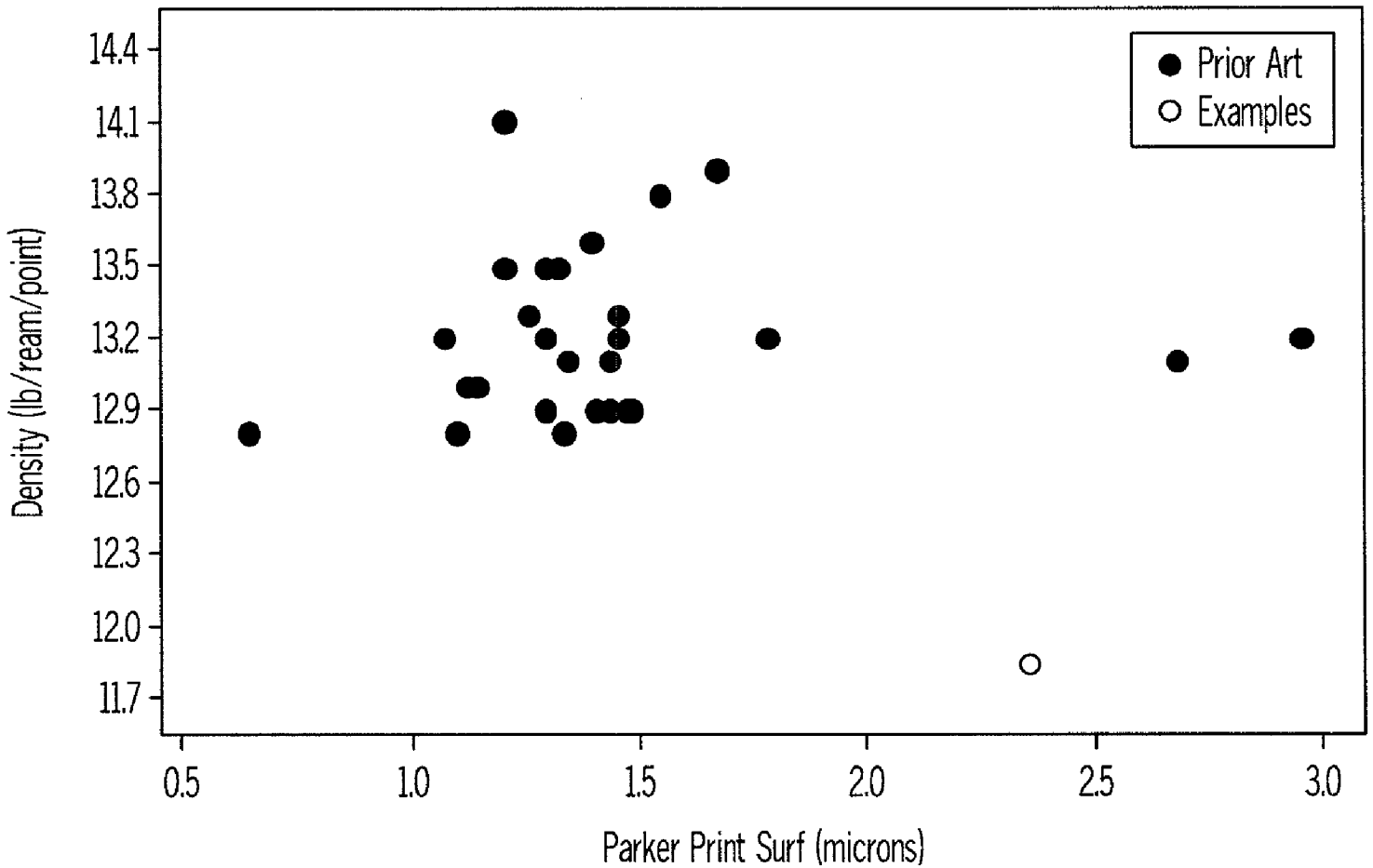
FIG. 7 is a graphical representation of density versus Parker Print Surf smoothness of an exemplary aspect of the disclosed low density paperboard having a caliper thickness of about 10 points.
Figure 8:
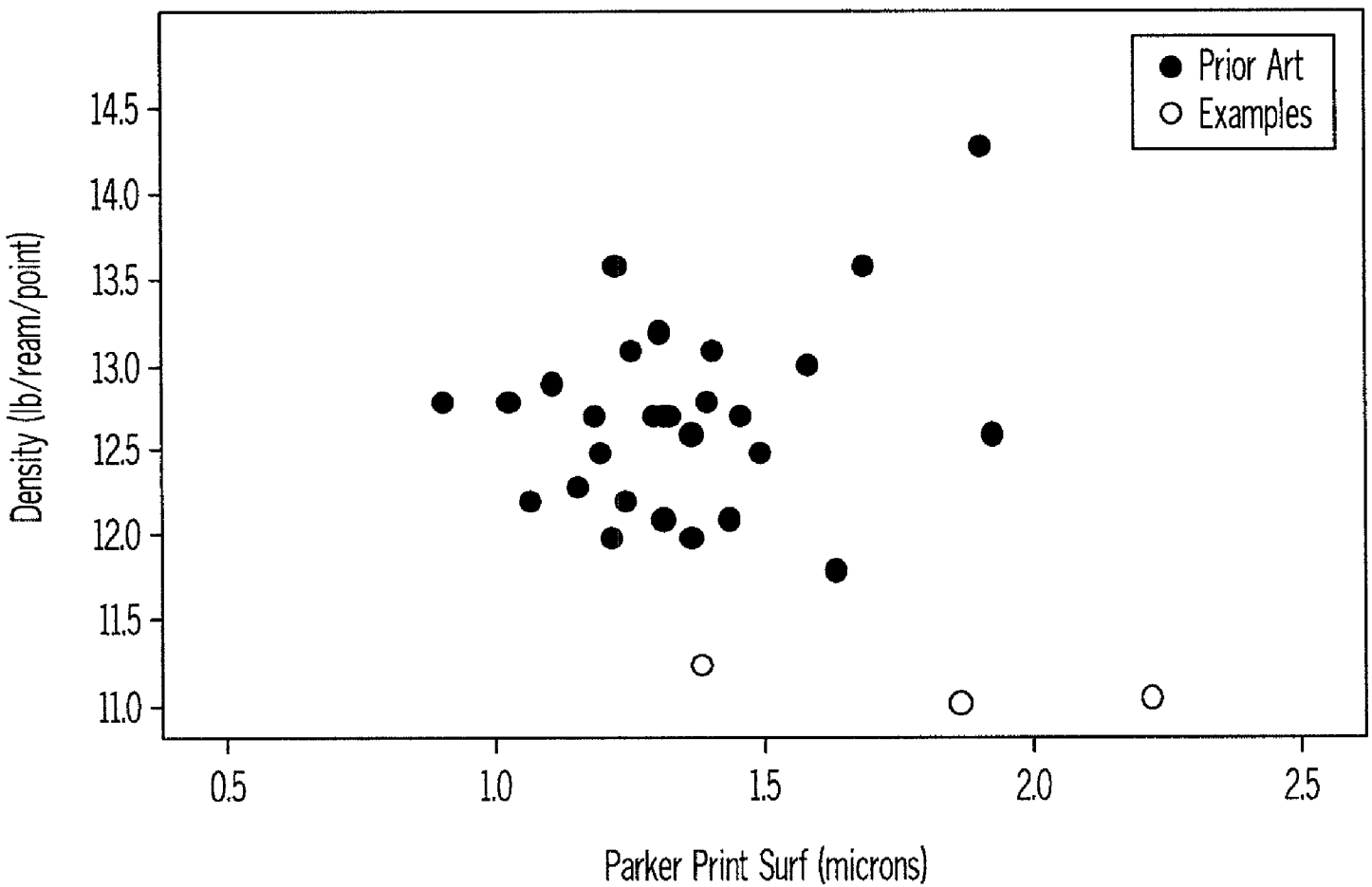
FIG. 8 is a graphical representation of density versus Parker Print Surf smoothness of various exemplary aspects of the disclosed low density paperboard having a caliper thickness of about 12 points.
Figure 9:
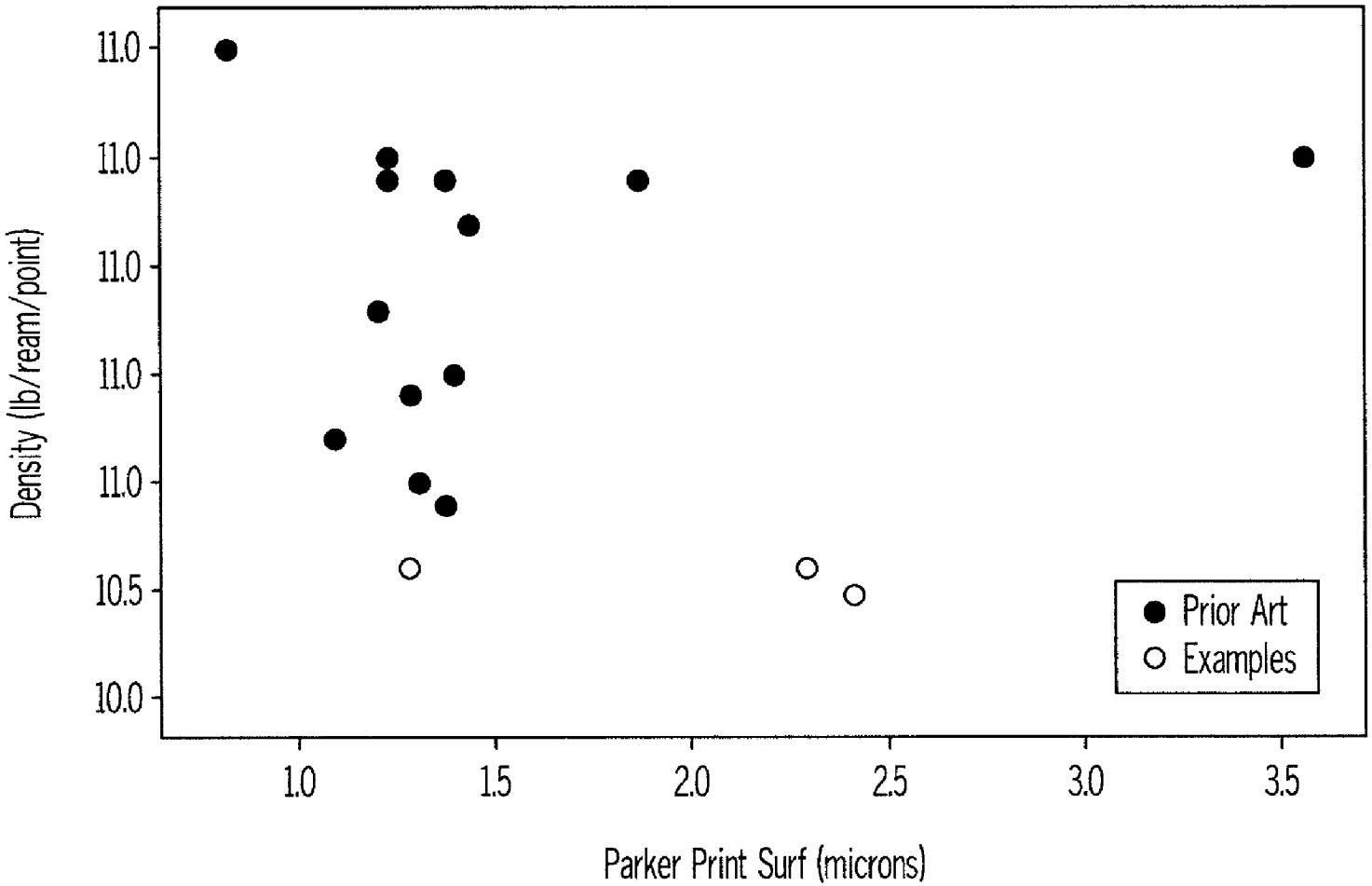
FIG. 9 is a graphical representation of density versus Parker Print Surf smoothness of various exemplary aspects of the disclosed low density paperboard having a caliper thickness of about 18 points.

FIG. 7 illustrates density versus Parker Print Surf smoothness for a 10 point board (Example 4) in accordance with the present disclosure, plotted against density versus Parker Print Surf smoothness of prior art 10 point board. FIG. 8 illustrates density versus Parker Print Surf smoothness of 12 point board (taken from Examples 1-6), plotted against density versus Parker Print Surf smoothness of prior art 12 point board. FIG. 9 illustrates density versus Parker Print Surf smoothness of 18 point board (taken from Examples 1-6), plotted against density versus Parker Print Surf smoothness of prior art 18 point board. Those skilled in the art will appreciate that the paperboard of the present disclosure presents significantly lower densities relative to the prior art, while maintaining smoothness (i.e., low Parker Print Surf smoothness values).

Figure 1:
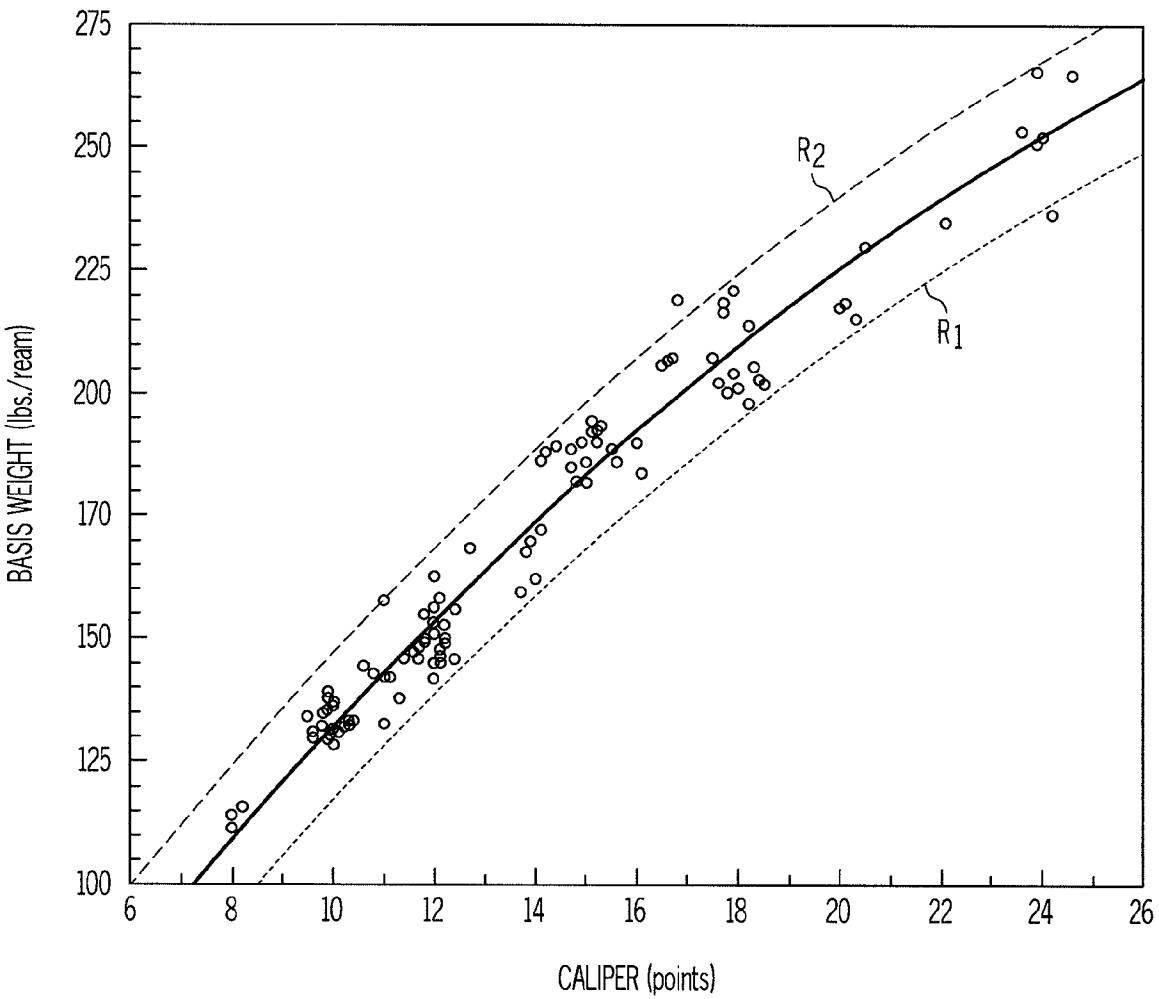
FIG. 1 (PRIOR ART)
FIG. 1 is a graphical representation of basis weight versus caliper thickness of certain prior art paperboard materials.
Figure 3:
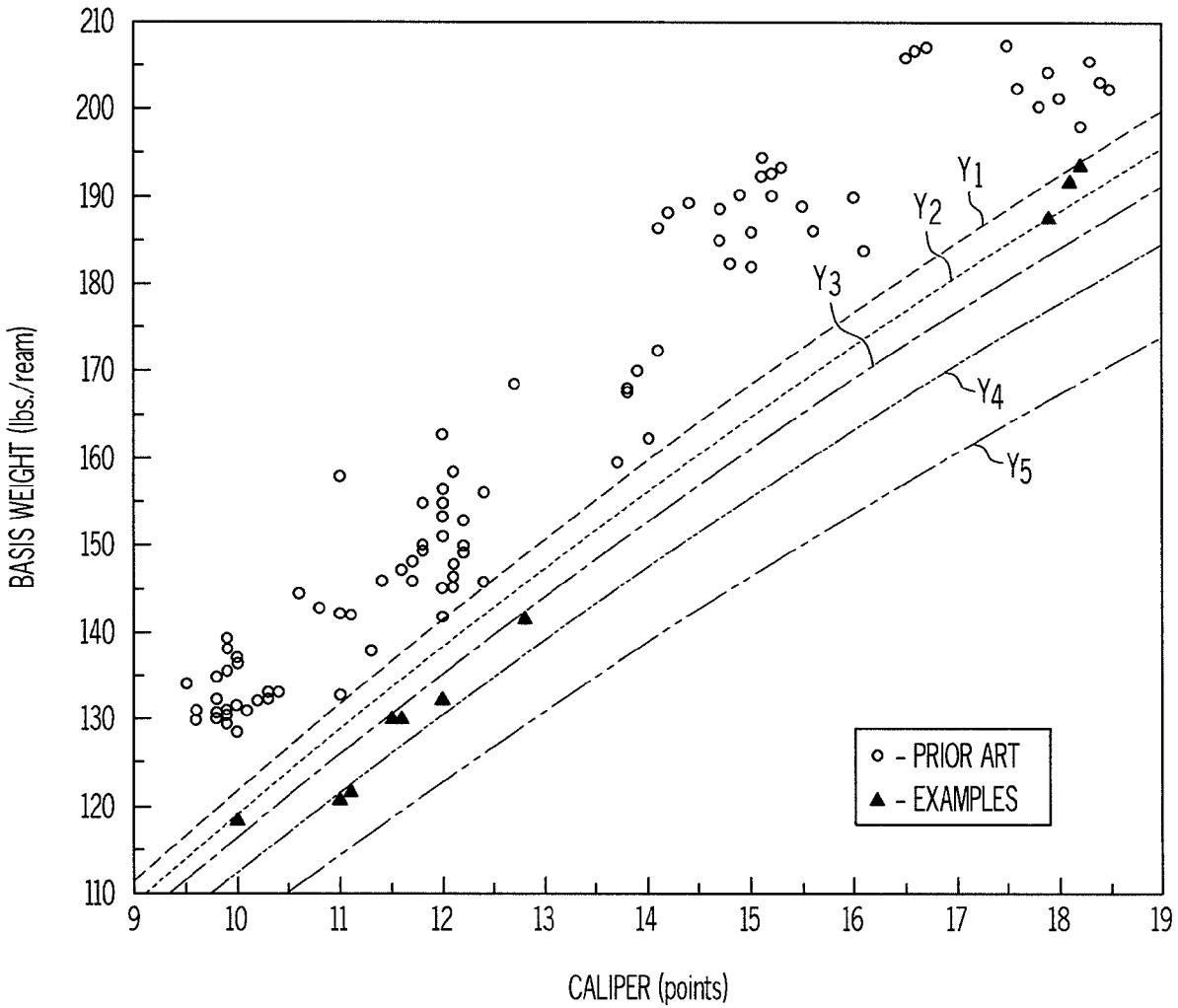
FIG. 3 is a graphical representation of basis weight versus caliper thickness of various exemplary aspects of the disclosed low density paperboard.

The basis weight versus caliper data from Examples 1-6, together with basis weight versus caliper data for prior art paperboard (FIG. 1), is plotted in FIG. 3. All of the data points from Examples 1-6 fall below curve $Y_1$, which is a plot of Eq. 1, while all of the prior art data is found above curve $Y_1$. Furthermore, eight of the data points from the disclosed Examples fall below curve $Y_2$, which is a plot of Eq. 2, six of the data points fall below curve $Y_3$, which is a plot of Eq. 3, and two of the data points fall below curve $Y_4$, which is a plot of Eq. 4.

Figure 10:
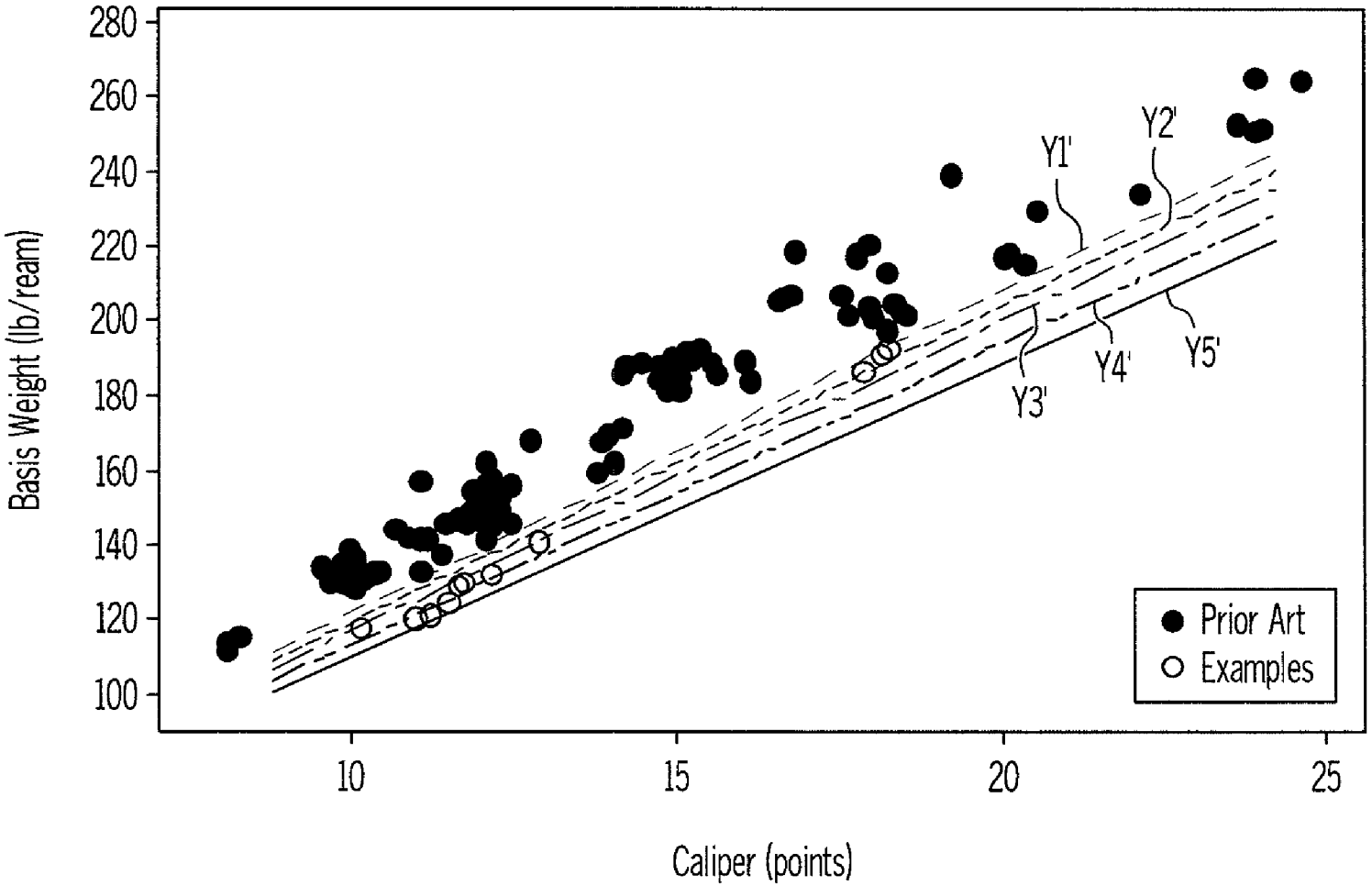
FIG. 10 is another graphical representation of basis weight versus caliper thickness of the various exemplary aspects shown in FIG. 3.

Similarly, basis weight versus caliper data of paperboard prepared in accordance with the present disclose, together with basis weight versus caliper data for prior art paperboard, is plotted in FIG. 10. All of the data points from fall below curve $Y_1'$, which is a plot of Eq. 6, while all of the prior art data is found above curve $Y_1'$. Furthermore, several data points fall below curve $Y_2'$, which is a plot of Eq. 7, with several more data points falling below curve $Y_3'$, which is a plot of Eq. 8, and others falling below curve $Y_4'$, which is a plot of Eq. 9.

While basis weight data is currently presented in FIGS. 3 and 10 for various caliper thickness ranges, those skilled in the art will appreciate that since the disclosed coatings and techniques were capable of achieving surprisingly low densities at about 10, 11, 12, 13 and 18 point calipers, it is to be expected that similar low densities may be achieved at other caliper thicknesses.

Thus, the paperboard of the present disclosure provides desired smoothness (e.g., PPS 10S smoothness below 3 microns, and even below 1.5 microns), while maintaining low board density (e.g., basis weight below the disclosed thresholds as a function of caliper thickness). While such paperboard has been desired, it is believed that it has not yet been achievable in the prior art.

Although various aspects of the disclosed low density paperboard have been shown and described, modifications may occur to those skilled in the art upon reading the specification. The present patent application includes such modifications and is limited only by the scope of the claims.

What is claimed is:

1. A paperboard comprising:

a solid bleached sulfate (SBS) paperboard substrate; and a coating applied to said paperboard substrate to form a coated structure, said coated structure having a basis weight, a caliper thickness and a Parker Print Surf smoothness, said Parker Print Surf smoothness being at most 3 microns, said basis weight being at most $Y_2$ pounds per 3000 $ft^2$, wherein $Y_2$ is a function of said caliper thickness (X) in points and is calculated as follows:

$$Y_2=3.71+13.14X-0.1602X^2.$$

2. The paperboard of claim 1 wherein said coating includes at least a basecoat and a topcoat, wherein said basecoat is positioned between said topcoat and said SBS paperboard substrate.

3. The paperboard of claim 2 wherein said coating further includes an intermediate coating layer positioned between said basecoat and said topcoat.

4. The paperboard of claim 1 wherein said coating includes starch.

5. The paperboard of claim 1 wherein said coating includes coarse ground calcium carbonate and high aspect ratio clay.

6. The paperboard of claim 1 wherein said basis weight is at most $Y_3$ pounds per 3000 $ft^2$, wherein $Y_3$ is calculated as follows:

$$Y_3=3.63+12.85X-0.1566X^2.$$

7. The paperboard of claim 1 wherein said basis weight is at most $Y_4$ pounds per 3000 $ft^2$, wherein $Y_4$ is calculated as follows:

$$Y_4=3.50+12.41X-0.1513X^2.$$

8. The paperboard of claim 1 wherein said Parker Print Surf smoothness is at most 2.5 microns.

9. The paperboard of claim 1 wherein said Parker Print Surf smoothness is at most 2.0 microns.

10. The paperboard of claim 1 wherein said Parker Print Surf smoothness is at most 1.5 microns.

11. The paperboard of claim 1 wherein said coating includes at least one pigment, and wherein each of said pigments in said coating is an inorganic pigment.

12. The paperboard of claim 1 with the proviso that said SBS paperboard substrate is substantially free of chemical bulking agents.

13. The paperboard of claim 1 wherein said SBS paperboard substrate has a basis weight of at least 85 pounds per 3000 $ft^2$.

14. The paperboard of claim 1 wherein said SBS paperboard substrate is a single-ply substrate.

15. The paperboard of claim 1 wherein said SBS paperboard substrate consists essentially of chemical pulp.

16. A paperboard comprising:

a solid bleached sulfate (SBS) paperboard substrate; and a coating applied to said paperboard substrate to form a coated structure, said coated structure having a basis weight, a caliper thickness and a Parker Print Surf smoothness, said Parker Print Surf smoothness being at most 3 microns, said basis weight being at most $Y_2'$ pounds per 3000 $ft^2$, wherein $Y_2'$ is a function of said caliper thickness (X) in points and is calculated as follows:

$$Y_2'=35.55+8.173X+0.01602X^2.$$

17. The paperboard of claim 16 wherein said basis weight is at most $Y_3'$ pounds per 3000 $ft^2$, wherein $Y_3'$ is calculated as follows:

$$Y_3'=34.83+8.010X+0.01570X^2.$$

18. The paperboard of claim 16 wherein said basis weight is at most $Y_4'$ pounds per 3000 $ft^2$, wherein $Y_4'$ is calculated as follows:

$$Y_4'=33.79+7.769X+0.01524X^2.$$

* * * * *